US006761423B2

(12) United States Patent
Ozaki et al.

(10) Patent No.: US 6,761,423 B2
(45) Date of Patent: Jul. 13, 2004

(54) INK-JET PRINTING APPARATUS THAT VIBRATES INK IN A PRESSURE CHAMBER WITHOUT EJECTING IT

(75) Inventors: Mitsuo Ozaki, Kawasaki (JP); Shino Tokuyo, Kawasaki (JP); Shigeharu Suzuki, Kawasaki (JP)

(73) Assignee: Fuji Photo Film Co., LTD, Minami-Ashigara (JP)

( * ) Notice: Subject to any disclaimer, the term of this patent is extended or adjusted under 35 U.S.C. 154(b) by 0 days.

(21) Appl. No.: 10/226,316

(22) Filed: Aug. 23, 2002

(65) Prior Publication Data

US 2003/0146947 A1 Aug. 7, 2003

Related U.S. Application Data

(63) Continuation of application No. PCT/JP00/01057, filed on Feb. 24, 2000.

(51) Int. Cl.[7] ..... B41J 29/38
(52) U.S. Cl. ..... 347/11; 347/9
(58) Field of Search ..... 347/5, 9, 11, 12, 347/13, 68, 57, 10, 60

(56) References Cited

U.S. PATENT DOCUMENTS 5,541,628 A * 7/1996 Chang et al. ..... 347/10
6,412,923 B1 * 7/2002 Takahishi ..... 347/68

FOREIGN PATENT DOCUMENTS

| | | |
|---|---|---|
| EP | 0 788 882 A2 | 8/1997 |
| JP | 55123476 A | 9/1980 |
| JP | 57034976 A | 2/1982 |
| JP | 57061576 A | 4/1982 |
| JP | 04080037 A | 3/1992 |
| JP | 9 201960 | 8/1997 |
| JP | 9 226116 | 9/1997 |
| JP | 10 6526 | 1/1998 |
| JP | 10 119271 | 5/1998 |
| JP | 2000-037867 | 2/2000 |

* cited by examiner

*Primary Examiner*—Juanita D. Stephens
(74) *Attorney, Agent, or Firm*—Armstrong, Kratz, Quintos, Hanson & Brooks, LLP

(57) ABSTRACT

An ink-jet printing apparatus comprises a plurality of nozzles that eject ink, the nozzles being grouped into two or more nozzle groups; pressure chambers, each being provided to one of the nozzles; ink-ejection energy generators, each being provided for one of the pressure chambers; and a vibration controller configured to supply a non-ejecting vibration signal to the ink-ejection energy generators of each nozzle group at a different timing. The non-ejecting vibration signal causes the corresponding ink-ejection energy generator to produce energy so as not to cause the ink to eject from the nozzle, but cause the liquid surface of the ink to slightly vibrate in the associated nozzle.

18 Claims, 7 Drawing Sheets

INK-JET PRINTING APPARATUS THAT VIBRATES INK IN A PRESSURE CHAMBER WITHOUT EJECTING IT

CROSS-REFERENCE

This patent application is a continuation application of PCT/JP00/01057 filed on Feb. 24, 2000, the entire contents of which are herein incorporated by reference.

BACKGROUND OF THE INVENTION

1. Field of the Invention

The present invention generally relates to an ink-jet printing apparatus, and more particularly, to an improved ink jet printing apparatus that can effectively prevent the viscosity of the ink filled in the ejecting nozzles from increasing and reduce ink jam at the ejecting nozzles.

2. Description of the Related Art

Recently, ink-jet printers that are usable as an output apparatus of an information processing apparatus (e.g., computers) have attracted a lot of attention. With an ink-jet printer, the running cost is less, while highly precise imaging and coloring processes are realized with a relatively simple technique. However, there are still many points to be improved in the ink-jet recording head of ink-jet printers.

The ink-jet head of an ink jet printer has a plurality of nozzles and pressure chambers communicating with the openings of the respective nozzles. An ejection energy generating means is driven in response to a print command to change the pressure in the chamber, which causes the ink to be ejected from the nozzles.

Ink droplets attached onto a recording medium may blur depending on the quality of the recording medium (e.g., paper quality), or may undesirably come into contact with other members and be smeared. To avoid such situations, ink is generally prepared so that the solvent promptly permeates the recording medium and then evaporates to fix the ink on the recording medium. However, this causes another problem, that is, the viscosity of ink increases due to evaporation of the solvent, especially in those nozzles that are not frequently used. The same problem also occurs it the printing operation is suspended for a while. Increase in ink viscosity causes ink jam. This problems becomes conspicuous when using an aqueous (water) ink containing a high-viscosity organic solvent, such as a humectant, containing as main components water and glycol or similar material. To prevent this problem, the nozzle openings are capped when the printing operation is suspended for a relatively long time, thereby preventing the evaporation of the ink solvent.

However, this countermeasure cannon prevent the ink jam from occurring during the printing operation in general, ink ejection is not uniform at all the nozzles, and there are some nozzles whose ejection frequency is quite low or which do not eject ink tar a long time, depending on the positional arrangement of the nozzle openings or on print data. At these nozzles, the ink solvent evaporates, and the viscosity of the ink filled in the nozzles increase. This results in the ink ejecting condition changing, and the dot positions are offset from the correct positions on the recording medium. In addition, ink ejection becomes unstable, and dots deform or are lacking. In the worst case, ink can not be ejected from the nozzles due to ink jam.

To overcome this problem, a technique for refreshing the ink in the nozzle to return the ink condition to the initial state has been proposed. This technique is used in a serial type printer in which the ink head moves with respect to the recording medium to print. With this technique, the recording head recedes to the non-printing area (i.e., the return area for the to-and-fro motion) after it carried out the printing operation for a predetermined time. In the non-printing area, a prescribed number of ink droplets are forcibly ejected from all the nozzle openings (which is referred to as spraying) to refresh the ink in the nozzle, and thereby returning to the initial condition.

However, this technique has several drawbacks. First, the printing operation has to be stopped regularly, and the printing rate is reduced. In addition, since in recent years the quantity of an ink droplet forming a dot is as little as several pico liters (pL), the interval between the spraying must be shortened to prevent the viscosity of the ink from increasing. This further causes the printing rate to decrease. Furthermore, the spray operation causes the ink consumption to increase. In order to conduct the spraying in a line printer in which a recording medium moves with respect to the recording head, an extra space for carrying out the spraying is needed, and the entire apparatus becomes large.

In conclusion, spraying cannot entirely solve the problems associated with increase of the ink viscosity.

There are some other known techniques for preventing ink jam. For example, Japanese Patent Application Laid-open (Kokai) No. 55-123476 discloses a printing apparatus using piezoelectric elements as ink-ejection energy generating means. In this apparatus, during the printing operation, a printing signal is applied, via a current-control resistance, to the piezoelectric element in the pressure chamber that corresponds to the nozzle not ejecting the ink, thereby slightly vibrating the liquid surface in the nozzle.

Japanese Patent Publication-after-Examination (Kokoku) No. 62-33074 and Japanese Patent Application Laid-open No. 4-80037 also disclose a technique for preventing ink jam by applying a voltage to the piezoelectric elements so as not to eject a ink droplet, but to vibrate the liquid surface at the nozzle openings. With this technique, it is not necessary for the apparatus to stop the printing operation, and therefore, the printing rate can be maintained, while preventing unnecessary ink consumption.

Slightly vibrating the liquid surface of the ink causes the ink particles to diffuse in the nozzle, thereby preventing the viscosity from increasing. This method is effective when using ink whose viscosity changes only gently and when the non-ejecting time is relatively short. If the non-ejecting time is long, the increase in viscosity can be still prevented by combining the liquid-surface vibrating method with the spraying technique.

However, in order to slightly vibrate the ink surface in the nozzle, a voltage is always applied to the ink ejecting means including during the non-printing period. This leads to still another problem in that the ink-ejection energy generating means wears easily, and the service life is shortened.

SUMMARY OF THE INVENTION

The present invention was conceived in view of the above-described problems, and it is an object of the present invention to provide an ink-jet printing apparatus that can produce slight vibration on the liquid surface in the nozzle in a efficient manner, while reducing the number of times of driving the ink-ejection energy generators. To achieve this object the ink-jet printing apparatus according to the present invention makes positive use of a so-called crosstalk phenomenon, in which the liquid surface of ink at a nozzle opening slightly vibrates under the influence of ink ejection from the adjacent nozzles.

In one aspect of the invention, an ink-jet printing apparatus comprises a plurality of nozzles configured to eject ink; pressure chambers, each corresponding to one of the nozzles; ink-ejection energy generators, each being provided to one of the pressure chambers; and a vibration controller configured to apply a non-ejecting vibration signal to the ink-ejection energy generator to cause the liquid surface of ink filled in the associated nozzle to slightly vibrate. The nozzles are grouped into two or more groups, and the vibration controller supplies the non-ejecting vibration signal to the ink-ejection energy generators of each nozzle group at a different timing. The voltage of the non-ejecting vibration signal is regulated so as not to cause the ink to eject from the nozzle, but only to slightly vibrate at the opening of each nozzle.

In other words, the vibration controller drives and causes the ink-ejection energy generator no produce energy that does not eject the ink from the nozzle, but causes the ink surface to slightly vibrate at the nozzle opening. The non-ejecting vibration signal is supplied sequentially to each nozzle group, varying the signal supply timing for each group. With this arrangement, the ink surface at a nozzle opening is always slightly vibrating, even when the non-ejecting vibration signal is not applied to this nozzle, because of propagation of vibration from the ink-ejection energy generators of the adjacent pressure chambers. The groups of ink-ejection energy generators take a rest group by group without application of non-ejecting vibration signal, while the ink surface of the associated nozzles are continuously slightly vibrating due to propagation of vibration from the adjacent nozzles. This arrangement allows the service life of the ink-ejection energy generators to be extended, while efficiently preventing the ink viscosity from increasing.

In this manner, the present invention positively makes use of the crosstalk, in which the vibration generated to eject ink for the printing operation affects the adjacent or neighborhood nozzles through structural members or through the ink channels. The reference frequency of the ink-ejection energy generator, which is used to cause the ink surface to slightly vibrate to prevent an increase in viscosity, is divided by a natural number to reduce the number of the ink-ejection energy generators driven at a time to half (½), one third (⅓), and so on. This arrangement can prevent the ink-ejection energy generator from deteriorating and extend their service life, while promoting the diffusion of ink inside the nozzle, Consequently, increase of ink viscosity and ink jam can be effectively prevented.

Conventionally, an effort has been made to reduce the crosstalk as much as possible in order to improve the particle property, which indicates the ink-ejection performance during printing. However it is difficult to completely remove the influence of the crosstalk because of the structure and the size of the recording head. For example, it is desirable for the variation in the ink-ejection rate due to crosstalk to be less than 20% and less than 10% is more desirable. However, it is difficult to make the variation less than 5%. If piezoelectric elements are used as ink-ejection energy generators, 10% to 20% variation in the ink-ejection rate corresponds to 5% to 15% variation in the driving voltage applied to the piezoelectric elements, although such a correspondence depends on various conditions, such as the structure of the ink head.

From the viewpoint of the vibration at the liquid surface utilized in the present invention, the vibration effect becomes smaller as crosstalk decreases. Accordingly, it is preferable to make use of crosstalk in the range driving every other nozzle or every few nozzles. This arrangement can maintain slight vibration at the liquid surface in all the nozzles, while preventing the ink viscosity from increasing. In addition, the number of times of driving the ink-ejection energy generator in each nozzle can be greatly reduced, and consequently, the service life of the ink-ejection energy generator can be extended.

The vibration controller used in the ink-jet printing apparatus according to the present invention has a reference frequency for slightly vibrating the ink surface, and it includes a frequency-dividing vibrating unit for driving the respective groups of ink-ejection energy generators, while shifting the phase for each nozzle group.

The ink-ejection energy generators are driven group by group by dividing the reference frequency by the number of nozzle groups. Accordingly, there is a rest period for each nozzle group, in which the ink-ejection energy generators belonging to that group are not driven. However, the liquid surface of the ink filled in the nozzles in the non-driven nozzle group can continuously vibrate at the reference frequency because of propagation of vibration from the adjacent ink-ejection energy generators belonging to different nozzle groups.

Preferably, the nozzles are grouped so that every predetermined number of nozzles belongs to the same nozzle group. For example, if the nozzles are grouped into three, then the nozzles are arranged according to a geometric rule, such as belong to the first group, the second group, the third group, the first group, the second group, the third group, and so on. When the ink-ejection energy generators in the first nozzle group are driven, the vibration propagates to the nozzles in the other groups, and consequently, the ink surface vibrates in all the nozzles, even if the ink-ejection energy generators in the other groups are in the non-driven period.

The ink-jet printer may have a printing area, in which ink is ejected from the nozzles to print data on the recording medium, and a non-printing area, in which the printing operation is not carried out the vibration controller applies the non-ejecting vibration signal to the ink-ejection energy generators when the nozzles are located in the non-printing area.

With this arrangement, the liquid surface of the ink filled in the nozzle slightly vibrates in the non-printing area, while vibration is not caused at the ink surface when the nozzle is located in the printing area. Accordingly, the printing operation is carried out in the desirable condition, while the ink viscosity is prevented from increasing.

The ink-jet printing apparatus may be of a serial type, which is designed so that the ink-jet recording head is moved (or scanned) with respect to the recording medium, and the vibration controller drives the ink-ejection energy generators for each nozzle group in the non-printing area when the recording head returns during its to-and-fro motion.

Since, with the serial-type ink-jet printing apparatus to which the present invention is applied, non-ejecting vibration (or slight vibration) is applied to the ink filled in the nozzles only in the non-printing area (or the return area), dot offset or ink jam can be prevented during the printing operation.

The ink-ejection energy generator is, for example, a piezoelectric element. Alternatively, a mechanism for boiling the ink by a heater and ejecting the ink by bubble pressure may be employed as the ink-ejection energy generator. Using a piezoelectric element is preferable because the piezoelectric element itself deforms in response to a driving voltage and the vibration effectively propagates to the surrounding members. The vibration generated by the ink-ejection energy generator causes the liquid surface (or the ink surface) to vibrate through the ink itself; however, allowing the vibration to propagate through a structural member of the recording head is more preferable.

From the above-described viewpoint, it is preferable that the pressure chamber is formed integrally with the ink-jet recording head in order to allow the vibration to propagate to the adjacent nozzles more effectively.

Preferably, the non-ejecting reference frequency of the vibration controller is synchronized with the frequency of the ink-ejection driving signal used in the printing operation. With this arrangement, the slight vibration generated in the non-printing area for the purpose of preventing the ink viscosity from increasing does not adversely affect the ink-ejecting operation during the printing.

The ink-jet printing apparatus may conduct a spraying operation in the non-printing area, in combination with the slight vibration applied to the ink surface. This arrangement can prevent the ink viscosity from increasing more efficiently.

The present invention is applicable to a so-called line printer having a highly integrated ink head with a number of nozzles, in which the recording medium is moved with respect to the high-integration ink head. In this case, the same effects and advantages can be achieved, namely, making use of the influence of the vibration from the adjacent ink-ejection energy generators to prevent ink-dot offset and ink jam, while extending the service life of the ink-ejection energy generator.

BRIEF DESCRIPTION OF THE DRAWINGS

Other objects, features, and advantages of the present invention will become more apparent from the following detailed description when read in conjunction with the accompanying drawings, in which:

FIG. 4 illustrates a test-apparatus used to confirm the performance of the ink-jet recording apparatus according to the embodiment, in which

FIG. 6 illustrates how the frequency-divided groups of piezoelectric elements are driven sequentially, in which

DETAIL DESCRIPTION OF THE PREFERRED EMBODIMENTS

The preferred embodiments of the present invention will now be described in detail with reference to the attached drawings.

Figure 1:
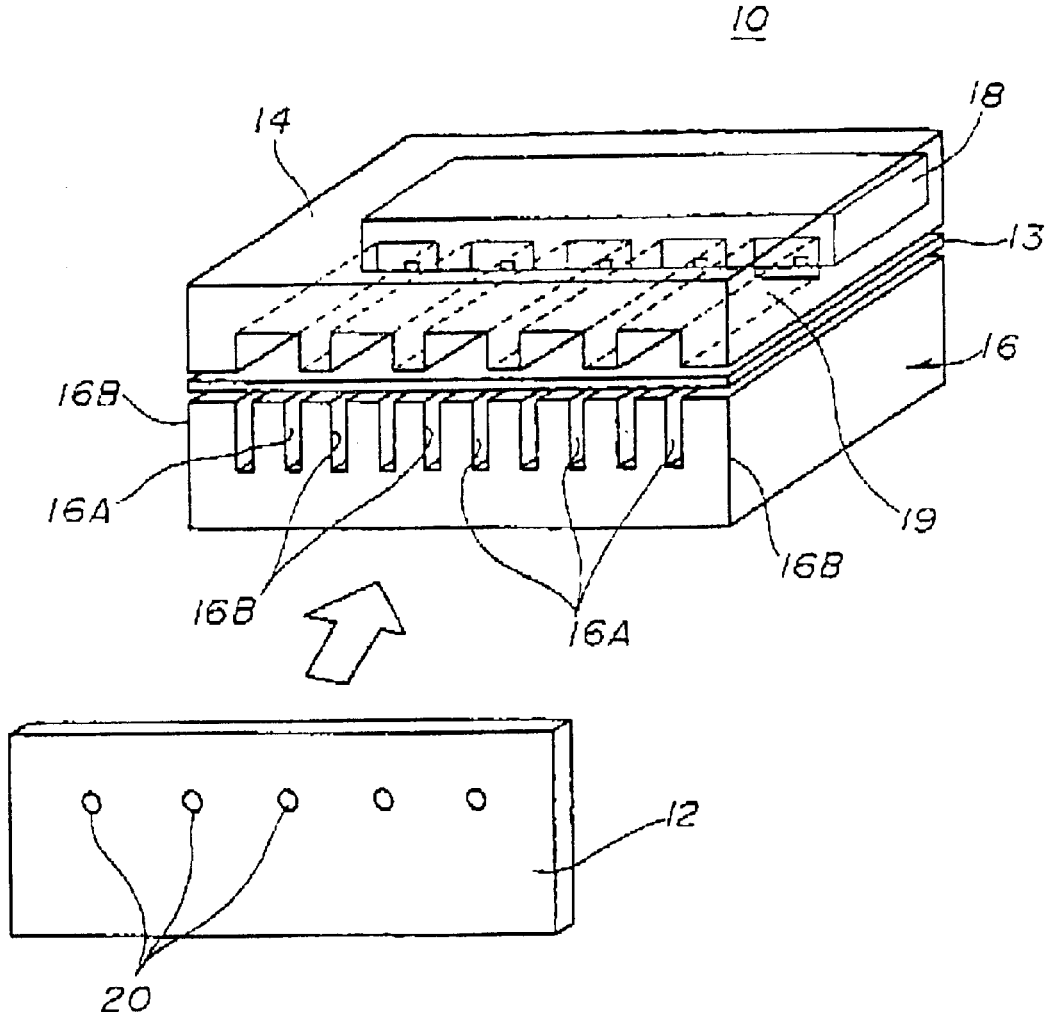
FIG. 1 is an exploded perspective view of the ink-jet recording head used in the ink-jet printing apparatus according to an embodiment of the invention in which the nozzle plate is separated from the ink head body for the sake of convenience in viewing.
Figure 2:
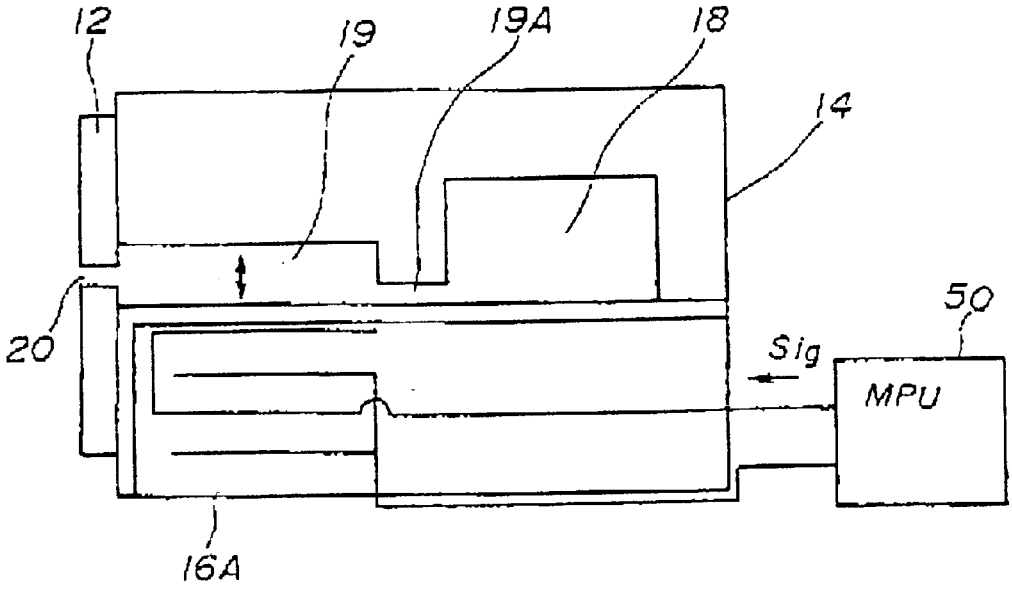
FIG. 2 is a cross-sectional side view showing an arrangement of parts of the semiconductor device package shown in FIG. 1.

FIG. 1 illustrates the ink-jet recording head 10, in a perspective view with the nozzle plate 12 separated, which is used in an ink-jet printing apparatus according to an embodiment of the invention, and FIG. 2 is a cross-sectional side view of the ink-jet recording head 10 shown in FIG. 1.

The ink-jet recording head 10 comprises the piezoelectric member 16, which functions as an ink-ejection energy generator, an ink channel board 14, and a nozzle plate 12. These components are combined together to form an ink channel that includes a common ink chamber 18 and branch channels 19. The piezoelectric member 16 has a comb-like cross-sectional view with multiple piezoelectric (or driving) elements 16A. A driving signal "Sig" is supplied from the driving controller (MPU: micro processing unit) 50 to the piezoelectric element 16A, as illustrated in FIG. 2, to cause the piezoelectric element 16A to deform, which induces a pressure change. The induced pressure change further causes the ink filled in the branch channels 19 to eject from the openings 20.

The common ink chamber 18 branches into multiple channels 19, which become pressure chambers 19 near the nozzle plate 12. Each pressure chamber 19 has an ink supply port 15A opposite to the nozzle opening 20. The ink supply port 19A communicates with the common ink chamber 18, to which ink is supplied from the ink supply source of an ink cartridge (not shown). The openings 20 are formed in the nozzle plate 12 so as to correspond to the respective pressure chambers 19.

The ink channel board 14 is bonded to the piezoelectric member 16 vial for example, resin fill 13, so that the pressure chamber 19 faces the piezoelectric element 16A. The nozzle plate 12 is also bonded to the piezoelectric member 16 and the channel board 14 so that the nozzle openings 20 are positioned at the open end (opposing the narrower ink supply port 19A) of the pressure chambers 19.

The piezoelectric member 16 is designed so as to be a basic part of the ink-jet recording head 10. The piezoelectric member 16 has multiple piezoelectric elements 16A and walls 16B arranged alternately. The walls 16B comprises a part of the framework of the ink-jet recording head 10, and the piezoelectric elements 16A, each being positioned between two adjacent walls 16B, functions as driving elements. Each piezoelectric element 16A receives an electric charge and deforms, thereby pressurizing the ink filled in the corresponding pressure chamber 19. The piezoelectric member 16 is comb-shaped so as not to prevent the deformation or displacement of the respective piezoelectric elements 16A The walls 16C function as crossbeams (or supports) to guarantee the rigidity of the ink-jet recording head 10.

When a voltage corresponding to a print command is applied to the piezoelectric element 16A, the piezoelectric element 16A deforms (or expands) toward the pressure chamber 19, and the ink is ejected from the nozzle opening 20. The pressure change occurring in the pressure chamber 19 is transferred to the other pressure chambers 19 via the material defining the pressure chambers 19. The pressure change is also transferred to the common ink chamber 18 via the ink supply port 19A, and to the other branch channels from the common ink chamber 19, thereby causing the ink surface in the nozzle to slightly vibrate In this manner, a vibration generated in a pressure chamber 19 propagates to the adjacent pressure chambers 19 via the structural members and the ink itself to cause the ink filled in the adjacent pressure chambers 19 to slightly vibrate.

The amplitude of the vibration propagating to the surroundings depends on the voltage applied to the piezoelectric element 16A, the shape, the size, the length, and the resistance of the ink channel, the physical properties of the ink, the structure of the recording head, etc. The pressure change generated in a pressure chamber 19 also induces another pressure change in the other nozzles, and especially, in the adjacent or opposed channels, either directly or indirectly via the structural members, and causes the liquid surface of the ink filled in the neighboring nozzles to slightly vibrate. This phenomenon is called crosstalk, and the ink-jet printing apparatus according to the present invention makes use of this phenomenon.

As illustrated in FIG. 2, the MPU 50, which functions as a vibration controller or a driving controller, supplies a driving signal to the piezoelectric element 16A to drive the piezoelectric element so as to eject the ink from the nozzle 20 during the printing operation. The MPU 50 supplies another type of signal, that is, a non-ejecting vibration signal, to the piezoelectric element 16A to cause the liquid surface of the ink filled in the nozzle to slightly vibrate. The MPU 50 has a reference frequency F for continuously causing non-ejecting vibration on the liquid surface of the ink. The MPU 50 divides the reference frequency by a prescribed natural number, which is consistent with the number of groups into which the nozzles are grouped, and drives each group of piezoelectric elements 16A, shifting the phase for each group by the frequency-divided slight-vibration signal. To this end, the MPU 50 also functions as a frequency-dividing vibration controller.

Figure 3:
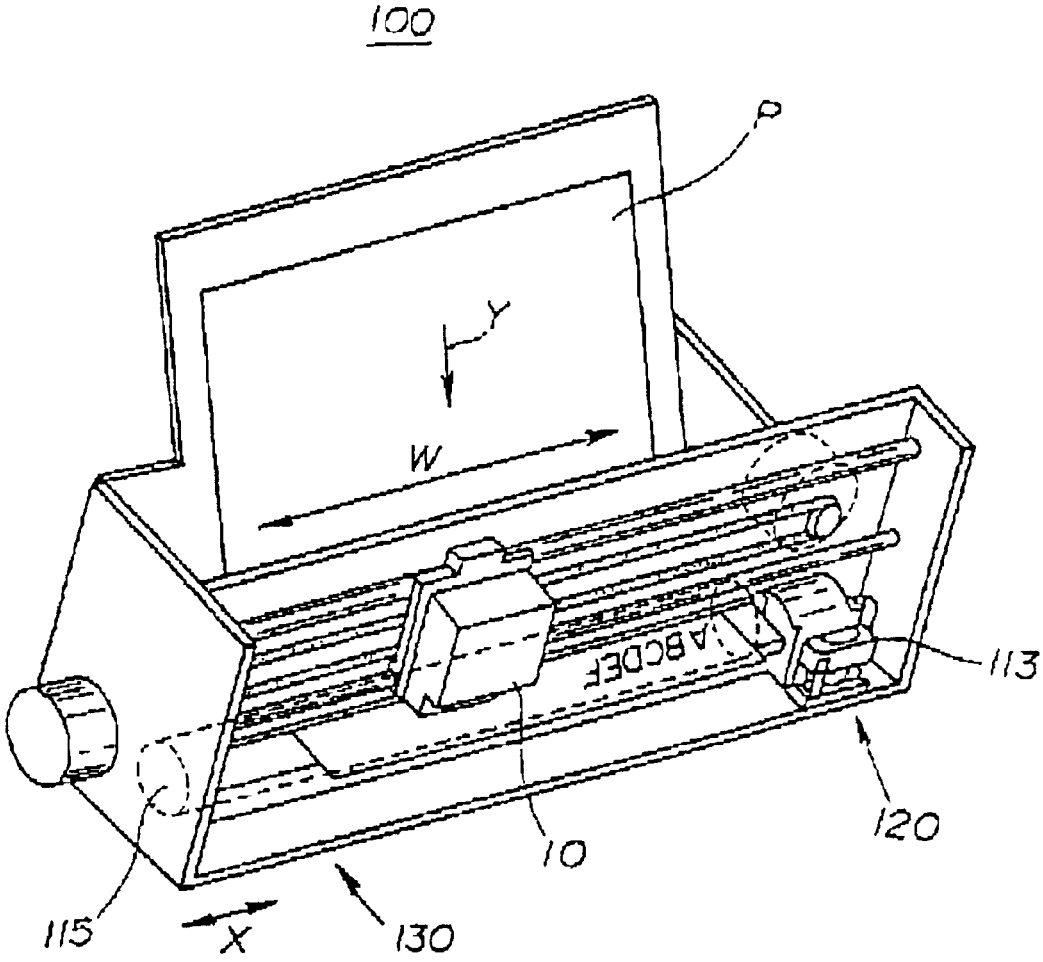
FIG. 3 is a perspective view of a serial-type ink-jet printing apparatus, in which the ink-jet recording head shown in FIG. 1 is mounted.

FIG. 3 illustrates an ink-jet printing apparatus 100 in which the above-described ink-jet recording head 10 is mounted. The ink-jet printing apparatus 100 is of a serial type, and accordingly, the ink-jet recording head 10 moves to and from the X-directions, as indicated by the bi-directional arrow. The ink-jet printing apparatus 100 has non-ejecting areas 120 and 130 one on each side of the printing area W. The non-printing area 120 functions as a return area, in which a spraying operation is carried out. For this reason, an ink-receiving unit 113 is provided in the return area 120. A recording medium (e.g., paper) P is fed in the Y-direction by a feed roller 115, and data are printed out on the recording medium P in the printing area W.

Various tests were conducted using three types of ink to study the effect of slight vibration at the ink surface for preventing the ink viscosity from increasing. In the test, a test apparatus, in which the above-described ink-let recording head 10 is mounted, is used.

Figure 4B:
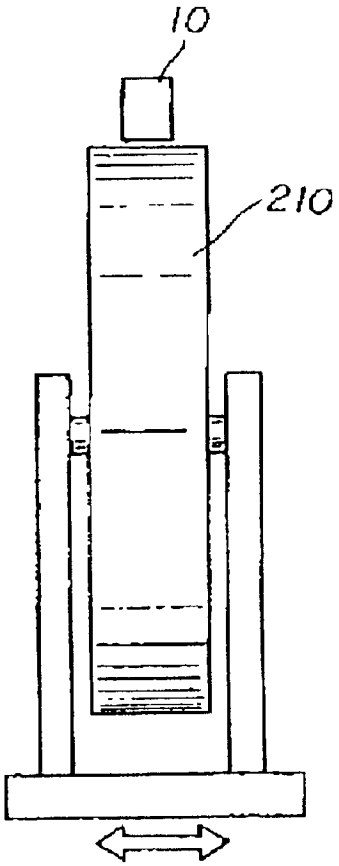
FIG. 4A is a front view of the test apparatus and FIG. 4B is a side view.
Figure 4A:
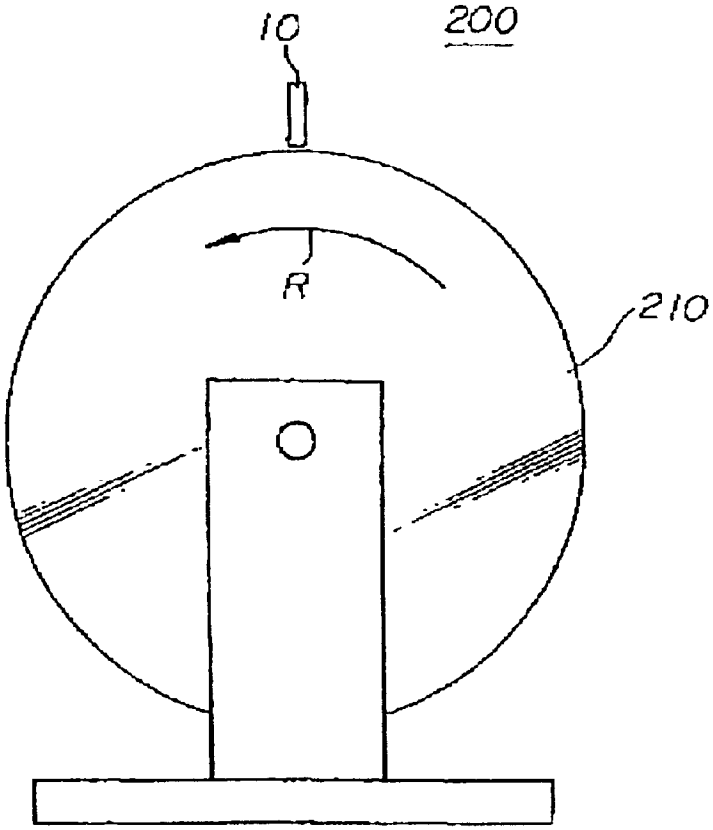

FIG. 4A is the front view of the test apparatus 200 used for the test, and FIG. 4B is the side view of the same apparatus 200.

The ink-jet recording head 10 used for the test has fifty nozzles, and the ink-jet recording head 10 is mounted in the test apparatus 10 so that the nozzle face faces the drum surface of the rotary drum 219. The nozzle line of the ink-jet recording head 10 extends perpendicular to the rotating direction R of the rotary drum 210.

The three types of inks used in the test are aqueous (or water) inks having a viscosity of about 2.5 mPaS (millipascal seconds) at 250° C. The major ingredients of the respective inks are listed below.

Ink I: 3% dye, 19% diethylene glycol, 5% other solvents and additives, the rest of the portion is water Ink II: 5% pigment, 2% disperser, 8% ethylene glycol, 5% glycerol, 6% other solvents and additives, the rest of the portion is water Ink III: 10% coloring resin, 10% glycerol, 5% other solvents and additives, the rest of the portion is water The rate of increase of viscosity due to evaporation of the solvent (mainly, water) depends on the ratio of the solid components and on the viscosity (or the type) of the humectant. Among the above-listed three inks, the viscosity of Ink III increases most easily, then, ink II and ink I follow in this order.

A glossy paper for exclusive use in ink-jet printing, which has less spread of ink, is placed on the rotary drum 210. The gap between the glossy paper and the nozzle face is set to 1 mm. When carrying out the printing operation in a normal room atmosphere, 40 pL (picoliters) ink formed a dot with a diameter of about 104 $\mu$m, and 8 pL ink formed a dot with a diameter of about 65 $\mu$m.

Under these conditions, spraying operation was first carried out prior to the printing test. In the spraying operation, 40 pL by 150 dots of ink were ejected from all the nozzles at a frequency of 7.2 kHz. Then, the printing test was conducted with 40 pL ink droplets and 8 pL ink droplets, varying the interval between slight vibrations (which may be referred to as "vibration interval") and the total non-ejecting time. After the printing test, the offset of the dot was observed.

Figure 5:
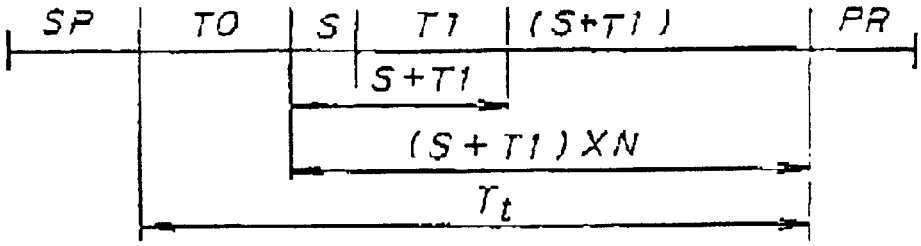
FIG. 5 is a basic timing chart for driving the tested piezoelectric elements.

FIG. 5 is a basic timing chart of the printing test, which shows how the piezoelectric element 16A was driven. After the spraying operation (SP), waiting time T0, in which neither ink ejection nor slight vibration of the ink surface is carried out, was provided. Then, slight vibration (i.e., non-ejecting vibration) was generated during the vibration time S, and interval T1 was taken after the vibration time S. The vibration time S and the interval T1 defined a set, and N times of set (S and T1) were repeated. Then, a printing operation (PR) was conducted to examine the change in the ink viscosity.

The vibration time S was set to about 0.1 seconds, while the interval T1 was varied among 1 second, 2 seconds, and 3 seconds. The reference frequency for the slight vibration (i.e., non-ejecting vibration) was set to 7.2 kHz.

For the respective inks (Ink I, Ink II, and Ink III), comparison tests (Comp. 1, Comp. 3, and Comp. 5) were also conducted, in which non-electing vibration was applied to all of the fifty nozzles at the reference frequency F, without grouping the nozzles, to continuously cause the liquid surface of ink to vibrate, as in the conventional method. In contrast, the nozzles were grouped into a few or several groups in example tests of the present invention, and each nozzle group was sequentially driven for slight vibration, while the rest of the nozzle groups were not vibrated. The test results are Shown in Table 2 through Table 19. These example tests that exhibit similar results with the comparison tests 1, 3 and 5 prove that the present invention can achieved the viscosity-increase prevention effect, while allowing the piezoelectric elements to rest, to an extent similar to the conventional method.

Other comparison tests (Comp. 2, Comp. 4, and Comp. 6) were also conducted for the respective inks (Ink I, Ink II, and Ink III), in which no vibration was applied to the piezoelectric elements contrary to Comparison tests 1, 3 and 5.

In the printing test, the waveform (including the pulse width and the amplitude) of the driving signal for ejecting ink is regulated so as to obtain a uniform ink droplet and a uniform ink-ejection rate at each temperature, taking into account the fact that the ink viscosity changes according to the temperature change or the environmental change. If the amplitude (or the voltage) of the driving signal for ejecting 40 pL ink droplets at each temperature is 1, which is used as a reference level, then, a non-ejecting vibration signal with about 70% amplitude of the driving signal is used at 20° C., and a non-ejecting vibration signal with about 60% amplitude of the driving signal is used at 40° C.

N times of vibration sets were repeated, where ore vibration set is defined as S+T1 (i.e., non-ejecting vibration time S plus interval T1). The value of N at various total repetition time (i.e., the total non-ejecting time) Tt and various interval T1 is shown in Table 1. After the total repetition time Tt, printing operation (PR) was conducted by applying a driving signal to the piezoelectric element so as to eject 40 pL by 10 dots ink droplets or 8 pL by 10 dots ink droplets. The revolution rate of the rotary drum 210 was adjusted so that the dots were printed with a space of about 150 μm between them.

TABLE 1

Repetition Number N and Total Repetition Time Tt

| | T1 = 1 sec | T1 = 2 sec | T1 = 3 sec |
|---|---|---|---|
| Tt = 4 sec | N = 3 | N = 1 | N = 1 |
| Tt = 12 sec | N = 10 | N = 5 | N = 3 |
| Tt = 20 Sec | N = 18 | N = 9 | N = 6 |
| Tt = 30 sec | N = 27 | N = 14 | N = 9 |

The test conditions described above are listed again for the sake of convenience.

Refreshing Spray (SP): 40 pL by 150 dots at 7.2 kHz
Vibration Interval T1: 1 sec, 2 sec, and 3 sec
Non-ejecting Vibrator. Time S: 0.1 sec
Total Repetition Time Tt. Tt=To+(S+T1)×N
Vibration Conditions:

Reference frequency of 7.2 kHz
Vibration time of 0.1 seconds
0.7 reference amplitude at 20° C., and
0.6 reference amplitude at 40° C., where the reference amplitude for ejecting 40 pL ink droplet is 1

The vibration time S contained in the total repetition time (or non-ejecting time) Tt after the spraying operation represents a period of time in which slight vibration is applied to the ink surface in the non-printing area. Vibration interval T1 is defined on the assumption that there is a nozzle that is not used to eject ink during the ordinary printing operation carried out in the printing area. As has beep described above, the printing test was conducted varying the vibration interval T1 to 1 second, 2 seconds, and 3 seconds, and influence on the ink viscosity was observed at each setting of the vibration interval T1. In addition, the influence on the ink viscosity was observed after the N sets of vibration time S and the vibration interval T1 were repeated (N≧1) in order to estimate the time at which spraying operation is required.

FIG. 6 illustrates how the respective groups of piezoelectric elements are sequentially driven at a frequency-divided timing. The reference frequency F of a non-ejecting vibration signal for producing slight vibration is divided by a known technique, and non-ejecting vibration signals are supplied to the respective groups of piezoelectric elements group by group, while shifting the phase of the non-ejecting vibration signal (i.e., by delaying the signal).

Figure 6A:
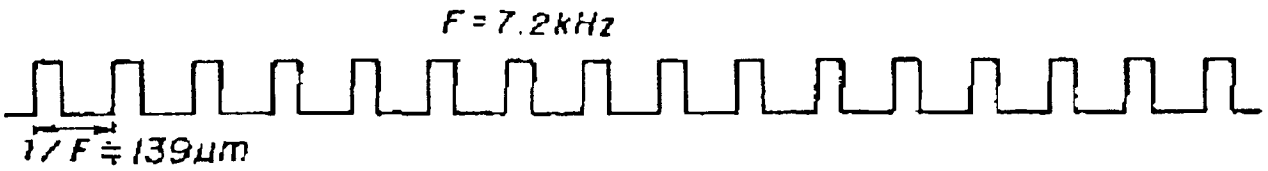
FIG. 6A shows the case where all the nozzles are driven at the reference frequency F.

FIG. 6A shows the pulse form of the reference frequency F, which is 7.2 kHz in the embodiment. The period is the reciprocal of the reference frequency, that is, 1/F=139 μs. Applying a non-ejecting vibration signal at the reference frequency F to all the piezoelectric elements corresponds to the conventional technique, which is likely to cause the piezoelectric elements to wear and deteriorate easily.

Figure 6B:
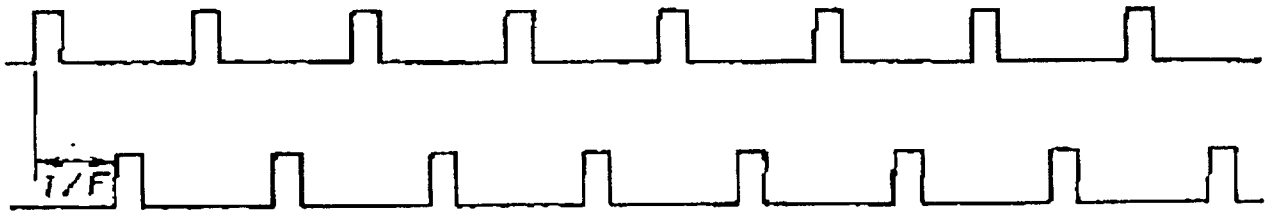
FIG. 6B shows the case where the nozzles are grouped into two groups.

FIG. 6B shows the pulse timing, where the nozzles are grouped into two nozzle groups. The nozzles arranged on the nozzle plate are grouped so that every other nozzle belong to the same nozzle group. In other words, the nozzles belong to the first nozzle group and the second nozzle group alternately. When applying the non-ejecting vibration signal, the reference frequency is divided by two (F/2), and 3.6 kHz vibration signal is applied to the piezoelectric elements of the first nozzle group. Then, another 3.6 kHz vibration signal is applied to the piezoelectric elements of the second nozzle group, while delaying (or shifting the phase of) the signal by a period (i.e., 1/F=139 μs) of the reference signal, as illustrated in FIG. 6B.

In FIG. 6B, the upper pulse form represents the frequency-divided non-ejecting vibration signal supplied to the first nozzle group, and the lower pulse form represents the frequency divided non-ejecting vibration signal supplied to the second nozzle group.

With this arrangement, the piezoelectric elements belonging to the first nozzle group take a rest every two pulses of the reference frequency F. However, the nozzles in the first nozzle group are affected by vibration having propagated from the nozzles in the second nozzle group, which are driven during the rest period of the first nozzle group. Consequently, the liquid surface of the ink filled in both the first-group nozzles and the second-group nozzles slightly vibrate at the reference frequency F, even without applying the non-ejecting vibration signal at the reference frequency F.

A printing test was conducted with the nozzles grouped into two and with the F/2 vibration signal, for The three types of inks (INK I, INK II, and INK III). The test results are exhibited as Ex. 1, Ex. 4, and Ex. 6 in Tables 2 through 13 listed below.

Figure 6C:
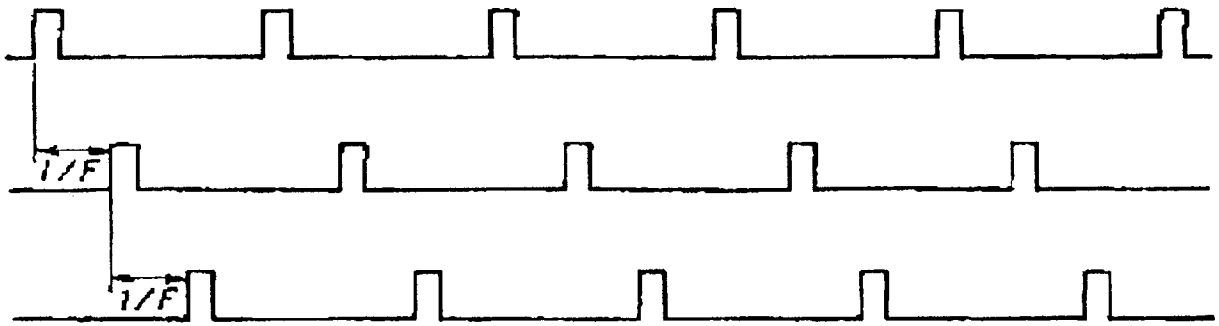
FIG. 6C shows the case where the nozzles are grouped into three groups.

FIG. 6C shows the pulse timing, where the nozzles are grouped into three nozzle groups. The nozzles arranged on the nozzle plate are grouped so that every third nozzle belongs to the same nozzle group. In other words, the nozzles belong to the first nozzle group, the second nozzle group, and the third nozzle group alternately. When applying the non-ejecting vibration signal, the reference frequency is divided by three (F/3), and a 2.4 kHz vibration signal is applied to the piezoelectric elements of the first nozzle group. Then, another 2.4 kHz vibration signal is applied to the piezoelectric elements of the second nozzle group, while delaying (or shifting the phase of) the signal by a period (i.e., 1/F=139 μs) of the reference signal. Still another 2.4 kHz vibration signal is then applied to the piezoelectric elements of the third nozzle group, while delaying (or shifting the phase of) the signal by a period (about 139 μs), as illustrated in FIG. 6C.

IN FIG. 6C, the top pulse form represents the frequency-divided non-ejecting vibration signal supplied to the first nozzle group, the middle pulse form represents the frequency-divided non-ejecting vibration signal supplied to the second nozzle group, and the bottom pulse form represents the frequency-divided non-ejecting vibration signal supplied to the third nozzle group.

With this arrangement, the piezoelectric elements belonging to the first nozzle group are driven only every three pulses of the reference frequency F, and make a rest at the subsequent two pulses. However, the nozzles in ache first nozzle group are affected by vibration having propagated from the nozzles belonging to the second and third nozzle groups, which are also driven every three pulses, but at shifted timings during the rest period of the first nozzle group. The same applies to the second and third nozzle groups. Consequently, the liquid surface of the ink filled in all of the first-group nozzles, the second-group nozzles, and the third-group nozzles slightly vibrate at the reference frequency F.

Figure 6D:
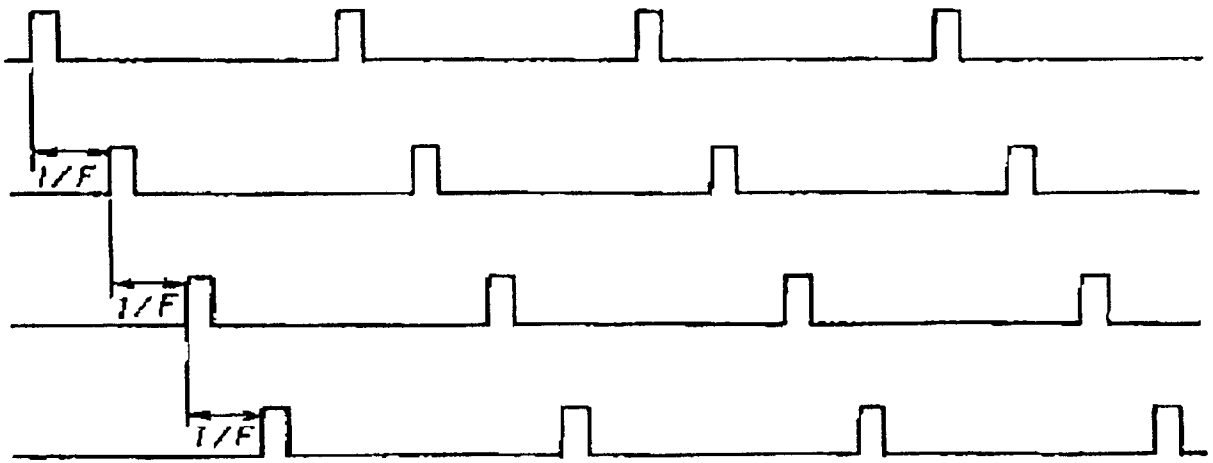
FIG. 6D shows the the where the nozzles are grouped into four groups.

FIG. 6D shows the pulse timing, where the nozzles are grouped into four nozzle groups. The nozzles arranged on the nozzle plate are grouped so that every fourth nozzle belong to the same nozzle group. In other words, the nozzles belong to the first nozzle group, the second nozzle group, the third nozzle group, and the fourth nozzle group alternately. When applying the non-ejecting vibration signal, the reference frequency is divided by four (F/4), and a 1.8 Hz vibration signal is applied to the piezoelectric elements of the first nozzle group. Then, another 1.8 kHz vibration signal is applied to the piezoelectric elements of the second nozzle group, while delaying (or shifting the phase of) the signal by a period (i.e., 1/F=139 μs) of the reference signal. Similarly, another 1.8 kHz vibration signal is Sequentially applied to the piezoelectric elements of the third and the fourth nozzle groups, while delaying (or shifting the phase of) the signal by a period (about 139 μs), as illustrated in FIG. 6D.

The piezoelectric elements belonging to the first nozzle group are driven only one of every fourth pulse of the reference frequency F, and take a rest at the subsequent three pulses. However, the nozzles in the first nozzle group are affected by vibration of the second, third, and fourth nozzle groups, which are also driven every four pulses, but at shifted timings during the rest period of the first nozzle group. The same applies to the second, third, and fourth nozzle groups. Consequently, the liquid surface of the ink filled in all the nozzles slightly vibrate at the reference frequency F.

A printing test was conducted for INK I with the nozzle grouped into four nozzle groups. The test results are exhibited as Ex. 3 shown in Tables 2 through 7.

The number of nozzle groups is not limited to the above-described examples, and they may be grouped into five or more nozzle groups.

Next, the test results and analysis as to the ink viscosity will be described with reference to Tables 2 through 19.

A 10-dot print sample was made in the printing test, and the distance between the ninth dot and the tenth dot (i.e., the last and the penultimate dots) was measured, which was used as the standard gap Gp. Then, the distance G1 between the first dot and the second dot was measured, and the positional displacement P1 of the first dot was calculated using Equation $$P1=(Gs-G1)\times 42.3/Gs$$

where a dot pitch of 600 DPI (i. e., 42.3 μm) is used as the reference.

When the viscosity of ink tends to increase, the earlier dots are likely to be affected by the change in viscosity, and the ejection speed slows down. As a result, the dots formed on the recording medium are offset from the correct positions. This means that the gap between the first dot and the second becomes narrower than the reference gap Gs. On the contrary the latter dots are less influenced by the increase of viscosity, and these dots are formed at the correct positions on the recording medium. Accordingly, the gap between the ninth dot and the tenth dot becomes substantially constant, and the sign of (Gs−G1) becomes positive. When the ink viscosity is increasing, the displacement P1 becomes larger in the positive direction.

In Tables 2 through 19 showing the test results, estimation was made with the following standard:

○: P1≦14 μm

Δ: 14 μm<P1≦28 μm

X: P1>28 μm where displacement within one third (⅓) of the reference dot pitch was acceptable and marked with a circle. The estimation result marked with a cross mark (X) includes the case in which the first dot was not ejected, or overlapped with the second or the subsequent dot.

Tables 2 through 7 show the estimation results using INK I. In Tables 2, 4, and 6, the quantity of ink droplet is a 8 pL, and the vibration interval T1 is set to 1 second, 2 seconds, and 3 seconds, respectively. In Tables 3, 5, and 7, the quantity of ink droplet is 8 pL, and The vibration interval T1 is set to 1 second, 2 seconds, and 3 seconds, respectively.

Example Test 1 (Ex. 1) exhibits the estimation result where nozzles are grouped into two nozzle groups and every two piezoelectric elements are driven. Example Test 2 (Ex. 2) exhibits the estimation results where nozzles are grouped into three nozzle groups and every three piezoelectric elements are driven. Example Test 3 (Ex. 3) exhibits the estimation result where nozzles are grouped into four nozzle groups and every four piezoelectric elements are driven. Comparison Test 1 (Comp. 1) exhibits the estimation result where all the nozzles are driven at the reference frequency F, and Comparison Test 2 (Comp. 2) exhibits the estimation result where no vibration is applied to the nozzles.

In order to study the influence of the environmental change, the printing test was conducted in three different environmental conditions with temperature and humidity varied, and the estimation results were obtained in the respective conditions in each Table.

TABLE 2

T1 = 1 sec Ink I Ink Quantity: 40 pl

| | Environment | Vibrating Cond | Total 4 | Rep. 12 | Time 20 | (sec) 30 |
|---|---|---|---|---|---|---|
| Ex. 1 | 20° C. 70% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | ○ | ○ |
| Comp. 1 | " | All nzls 7.2 kHz | ○ | ○ | ○ | ○ |
| Comp. 2 | " | No vibrn (S = 0) | ○ | ○ | Δ | Δ |
| Ex. 1 | 20° C. 40% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | ○ | Δ |
| Comp. 1 | " | All nzls 7.2 kHz | ○ | ○ | ○ | ○ |
| Comp. 2 | " | No vibrn (S = 0) | ○ | Δ | X | X |
| Ex. 1 | 40° C. 40% RH | every 2 nzls | ○ | ○ | ○ | ○ |
| Ex. 2 | " | every 3 nzls | ○ | ○ | ○ | ○ |

TABLE 2-continued

T1 = 1 sec Ink I Ink Quantity: 40 pl

| | Environment | Vibrating Cond | Total 4 | Rep. 12 | Time 20 | (sec) 30 |
|---|---|---|---|---|---|---|
| Ex. 3 | " | every 4 nzls | ○ | ○ | ○ | Δ |
| Comp. 1 | " | All nzls 7.2 kHz | ○ | ○ | ○ | ○ |
| Comp. 2 | " | No vibrn (S = 0) | ○ | X | X | |

TABLE 3

T1 = 1 sec Ink I Ink Quantity: 8 pl

| | Environment | Vibrating Cond. | Total 4 | Rep. 12 | Time 20 | (sec) 30 |
|---|---|---|---|---|---|---|
| Ex. 1 | 20° C. 70% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | ○ | Δ |
| Comp. 1 | " | All nzls 7.2 kHz | ○ | ○ | ○ | ○ |
| Comp. 2 | " | No vibrn (S = 0) | ○ | ○ | Δ | X |
| Ex. 1 | 20° C. 40% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | ○ | X |
| Comp. 1 | " | All nzls 7.2 kHz | ○ | ○ | ○ | ○ |
| Comp. 2 | " | No vibrn (S = 0) | ○ | Δ | X | X |
| Ex. 1 | 40° C. 40% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | Δ | X |
| Comp. 1 | " | All nzls 7.2 kHz | ○ | ○ | ○ | ○ |
| Comp. 2 | " | No vibrn (S = 0) | Δ | X | X | |

TABLE 4

T1 = 2 sec Ink I Ink Quantity: 40 pl

| | Environment | Vibrating Cond. | Total 4 | Rep. 12 | Time 20 | (sec) 30 |
|---|---|---|---|---|---|---|
| Ex. 1 | 20° C. 70% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | ○ | ○ |
| Comp. 1 | " | All nzls 7.2 kHz | ○ | ○ | ○ | ○ |
| Ex. 1 | 20° C. 40% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | ○ | Δ |
| Comp. 1 | " | All nzls 7.2 kHz | ○ | ○ | ○ | ○ |
| Ex. 1 | 40° C. 40% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | ○ | Δ |
| Comp. 1 | " | All nzls 7.2 kHz | ○ | ○ | ○ | ○ |

TABLE 5

T1 = 2 sec Ink I Ink Quantity: 8 pl

| | Environment | Vibrating Cond. | Total 4 | Rep. 12 | Time 20 | (sec) 30 |
|---|---|---|---|---|---|---|
| Ex. 1 | 20° C. 70% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | ○ | Δ |
| Comp. 1 | " | All nzls 7.2 kHz | ○ | ○ | ○ | ○ |
| Ex. 1 | 20° C. 40% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | Δ | X |
| Comp. 1 | " | All nzls 7.2 kHz | ○ | ○ | ○ | ○ |
| Ex. 1 | 40° C. 40% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | Δ | X |
| Comp. 1 | " | All nzls 7.2 kHz | ○ | ○ | ○ | ○ |

TABLE 6

T1 = 3 sec Ink I Ink Quantity: 40 pl

| | Environment | Vibrating Cond. | Total 4 | Rep. 12 | Time 20 | (sec) 30 |
|---|---|---|---|---|---|---|
| Ex. 1 | 20° C. 70% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | ○ | ○ |
| Comp. 1 | " | All nzls 7.2 kHz | ○ | ○ | ○ | ○ |
| Ex. 1 | 20° C. 40% RH | every 2 nzls | ○ | ○ | ○ | ○ |
| Ex. 2 | " | every 3 nzls | ○ | ○ | ○ | ○ |
| Ex. 3 | " | every 4 nzls | ○ | ○ | Δ | X |
| Comp. 1 | " | All nzls 7.2 kHz | ○ | ○ | ○ | ○ |
| Ex. 1 | 40° C. 40% RH | every 2 nzls | ○ | ○ | ○ | ○ |
| Ex. 2 | " | every 3 nzls | ○ | ○ | ○ | Δ |
| Ex. 3 | " | every 4 nzls | ○ | ○ | X | X |
| Comp. 1 | " | All nzls 7.2 kHz | ○ | ○ | ○ | ○ |

TABLE 7

T1 = 3 sec Ink I Ink Quantity: 8 pl

| | Environment | Vibrating Cond. | Total 4 | Rep. 12 | Time 20 | (sec) 30 |
|---|---|---|---|---|---|---|
| Ex. 1 | 20° C. 70% RH | every 2 nzls | ○ | ○ | ○ | ○ |
| Ex. 2 | " | every 3 nzls | ○ | ○ | ○ | Δ |
| Ex. 3 | " | every 4 nzls | ○ | ○ | ○ | X |
| Comp. 1 | " | All nzls 7.2 kHz | ○ | ○ | ○ | ○ |
| Ex. 1 | 20° C. 40% RH | every 2 nzls | ○ | ○ | ○ | ○ |
| Ex. 2 | " | every 3 nzls | ○ | ○ | Δ | X |
| Ex. 3 | " | every 4 nzls | ○ | ○ | X | X |
| Comp. 1 | " | All nzls 7.2 kHz | ○ | ○ | ○ | ○ |
| Ex. 1 | 40° C. 40% RH | every 2 nzls | ○ | ○ | ○ | Δ |
| Ex. 2 | " | every 3 nzls | ○ | ○ | X | X |
| Ex. 3 | " | every 4 nzls | ○ | Δ | X | X |
| Comp. 1 | " | All nzls 7.2 kHz | ○ | ○ | ○ | ○ |

Table 2 shows the estimation result of Ink I, using 40 pL ink droplets, with the vibration interval T1 of 1 second. Ink I has a viscosity-increase prevention property, and therefore, the dot positions printed on the recording medium were well maintained at or near the correct positions even after a relatively long repetition time (i.e., non-ejecting time) Tt, in which slight vibration was periodically applied to the nozzles. All the estimation results, including the case in which slight vibration is applied every third nozzle, reside within the acceptable range, and exhibit good results.

Table 3 shows the estimation result of ink I, using 8 pL ink droplets, with the vibration interval T1 of 1 second. Since the quantity of the ink droplet is smaller, it is likely to be subjected to the influence of increase in viscosity. Dot displacement becomes larger without application of slight vibration. However, if the nozzles are grouped into two or three nozzle groups, and if the piezoelectric elements of every two or three nozzles are driven, dot displacement is well prevented, as in the case in which all the nozzles are driven at the reference frequency F (7.2 kHz in the test). When the nozzles are grouped into four nozzle groups, dot displacement can still be prevented if a spraying operation is carried out, in combination with slight vibration, to refresh the ink in the nozzles.

Tables 4 and 5 show the estimation result of ink I, using 40 pL ink droplets and 8 pL ink droplets, respectively, with the vibration interval T1 of 2 seconds. Tables 6 and 7 show the estimation result of ink I, using 40 pL ink droplets and 8 pL ink droplets, respectively, with the vibration interval T1 of 3 seconds. In Tables 4 through 7, dot displacement becomes conspicuous it every four nozzles are vibrated at a low humidity using a lesser quantity of ink droplet (8 pL). However, if the nozzles are grouped into two or three groups, dot displacement is well prevented as in the case where all the nozzles are vibrated at the reference frequency F. In Tables 4 through 7, Comparison Test 2 (Comp. 2) was not conducted because, in, Comparison Test 2, no vibration is applied to the nozzles, and therefore, the estimation result is not affected at all by change of the vibration interval T1. It is assumed that the estimation result of Comparison Test 2 in Tables 2 and 3 could apply to Tables 4 through 7.

Similarly, Tables 8 through 13 show the estimation results using INK II, and Tables 14 through 19 shows the estimation results using Ink III with various conditions.

TABLE 8

T1 = 1 sec Ink II Ink Quantity: 40 pl

| | Environment | Vibrating Cond. | Total 4 | Rep. 12 | Time 20 | (sec) 30 |
|---|---|---|---|---|---|---|
| Ex. 4 | 20° C. 70% RH | every 2 nzls | ○ | ○ | ○ | ○ |
| Ex. 5 | " | every 3 nzls | ○ | ○ | ○ | ○ |
| Comp. 3 | " | All nzls 7.2 kHz | ○ | ○ | ○ | ○ |
| Comp. 4 | " | No vibrn (S = 0) | ○ | ○ | X | X |
| Ex. 4 | 20° C. 40% RH | every 2 nzls | ○ | ○ | ○ | ○ |
| Ex. 5 | " | every 3 nzls | ○ | ○ | ○ | Δ |
| Comp. 3 | " | All nzls 7.2 kHz | ○ | ○ | ○ | ○ |
| Comp. 4 | " | No vibrn (S = 0) | ○ | Δ | X | X |
| Ex. 4 | 40° C. 40% RH | every 2 nzls | ○ | ○ | ○ | ○ |
| Ex. 5 | " | every 3 nzls | ○ | ○ | ○ | Δ |
| Comp. 3 | " | All nzls 7.2 kHz | ○ | ○ | ○ | ○ |
| Comp. 4 | " | No Vibrn (S = 0) | Δ | Δ | X | X |

TABLE 9

T1 = 1 sec Ink II Ink Quantity: 8 pl

| | Environment | Vibrating Cond. | Total 4 | Rep. 12 | Time 20 | (sec) 30 |
|---|---|---|---|---|---|---|
| Ex. 4 | 20° C. 70% RH | every 2 nzls | ○ | ○ | ○ | ○ |
| Ex. 5 | " | every 4 nzls | ○ | ○ | ○ | Δ |
| Comp. 3 | " | All nzls 7.2 kHz | ○ | ○ | ○ | ○ |
| Comp. 4 | " | No vibrn (S = 0) | ○ | X | X | |
| Ex. 4 | 20° C. 40% RH | every 2 nzls | ○ | ○ | ○ | X |
| Ex. 5 | " | every 4 nzls | ○ | ○ | Δ | X |
| Comp. 3 | " | All nzls 7.2 kHz | ○ | ○ | ○ | Δ |
| Comp. 4 | " | No vibrn (S = 0) | Δ | X | X | |
| Ex. 4 | 40° C. 40% RH | every 2 nzls | ○ | ○ | Δ | X |
| Ex. 5 | " | every 3 nzls | ○ | ○ | X | X |
| Comp. 3 | " | All nzls 7.2 kHz | ○ | ○ | ○ | X |
| Comp. 4 | " | No Vibrn (S = 0) | X | X | | |

TABLE 10

T1 = 2 sec Ink II Ink Quantity: 40 pl

| | Environment | Vibrating Cond. | Total 4 | Rep. 12 | Time 20 | (sec) 30 |
|---|---|---|---|---|---|---|
| Ex. 4 | 20° C. 70% RH | every 2 nzls | ○ | ○ | ○ | ○ |
| Ex. 5 | " | every 3 nzls | ○ | ○ | ○ | ○ |
| Comp. 3 | " | All nzls 7.2 kHz | ○ | ○ | ○ | ○ |
| Ex. 4 | 20° C. 40% RH | every 2 nzls | ○ | ○ | ○ | ○ |
| Ex. 5 | " | every 3 nzls | ○ | ○ | ○ | X |
| Comp. 3 | " | All nzls 7.2 kHz | ○ | ○ | ○ | ○ |
| Ex. 4 | 40° C. 40% RH | every 2 nzls | ○ | ○ | ○ | ○ |
| Ex. 5 | " | every 3 nzls | ○ | ○ | Δ | X |
| Comp. 3 | " | All nzls 7.2 kHz | ○ | ○ | ○ | ○ |

TABLE 11

T1 = 2 sec Ink II Ink Quantity: 8 pl

| | Environment | Vibrating Cond. | Total 4 | Rep. 12 | Time 20 | (sec) 30 |
|---|---|---|---|---|---|---|
| Ex. 4 | 20° C. 70% RH | every 2 nzls | ○ | ○ | ○ | Δ |
| Ex. 5 | " | every 3 nzls | ○ | ○ | Δ | Δ |
| Comp. 3 | " | All nzls 7.2 kHz | ○ | ○ | ○ | ○ |
| Ex. 4 | 20° C. 40% RH | every 2 nzls | ○ | ○ | X | X |
| Ex. 5 | " | every 3 nzls | ○ | Δ | X | X |
| Comp. 3 | " | All nzls 7.2 kHz | ○ | ○ | Δ | X |
| Ex. 4 | 40° C. 40% RH | every 2 nzls | ○ | ○ | X | X |
| Ex. 5 | " | every 3 nzls | ○ | X | X | |
| Comp. 3 | " | All nzls 7.2 kHz | ○ | ○ | Δ | X |

TABLE 12

T1 = 3 sec Ink II Ink Quantity: 40 pl

| | Environment | Vibrating Cond. | Total 4 | Rep. 12 | Time 20 | (sec) 30 |
|---|---|---|---|---|---|---|
| Ex. 4 | 20° C. 70% RH | every 2 nzls | ○ | ○ | ○ | ○ |
| Ex. 5 | " | every 3 nzls | ○ | ○ | ○ | Δ |
| Comp. 3 | " | All nzls 7.2 kHz | ○ | ○ | ○ | ○ |
| Ex. 4 | 20° C. 40% RH | every 2 nzls | ○ | ○ | ○ | ○ |
| Ex. 5 | " | every 3 nzls | ○ | Δ | Δ | X |
| Comp. 3 | " | All nzls 7.2 kHz | ○ | ○ | ○ | ○ |
| Ex. 4 | 40° C. 40% RH | every 2 nzls | ○ | ○ | ○ | ○ |
| Ex. 5 | " | every 3 nzls | ○ | Δ | X | X |
| Comp. 3 | " | All nzls 7.2 kHz | ○ | ○ | ○ | ○ |

TABLE 13

T1 = 3 sec Ink II Ink Quantity: 8 pl

| | Environment | Vibrating Cond. | Total 4 | Rep. 12 | Time 20 | (sec) 30 |
|---|---|---|---|---|---|---|
| Ex. 4 | 20° C. 70% RH | every 2 nzls | ○ | ○ | Δ | X |
| Ex. 5 | " | every 3 nzls | ○ | ○ | X | X |
| Comp. 3 | " | All nzls 7.2 kHz | ○ | ○ | ○ | Δ |
| Ex. 4 | 20° C. 40% RH | every 2 nzls | ○ | Δ | X | X |
| Ex. 5 | " | every 3 nzls | ○ | X | X | |
| Comp. 3 | " | All nzls 7.2 kHz | ○ | Δ | X | X |
| Ex. 4 | 40° C. 40% RH | every 2 nzls | ○ | X | X | |
| Ex. 5 | " | every 3 nzls | ○ | X | X | |
| Comp. 3 | " | All nzls 7.2 kHz | ○ | Δ | X | X |

TABLE 14

T1 = 1 sec Ink III Ink Quantity: 40 pl

| | Environment | Vibrating Cond. | Total 4 | Rep. 12 | Time 20 | (sec) 30 |
|---|---|---|---|---|---|---|
| Ex. 6 | 20° C. 70% RH | every 2 nzls | ○ | ○ | ○ | ○ |
| Ex. 7 | " | every 3 nzls | ○ | ○ | ○ | X |
| Comp. 5 | " | All nzls 7.2 kHz | ○ | ○ | ○ | ○ |
| Comp. 6 | " | No vibrn (S = 0) | ○ | ○ | X | X |
| Ex. 6 | 20° C. 40% RH | every 2 nzls | ○ | ○ | ○ | Δ |
| Ex. 7 | " | every 3 nzls | ○ | ○ | ○ | X |
| Comp. 5 | " | All nzls 7.2 kHz | ○ | ○ | ○ | ○ |
| Comp. 6 | " | No vibrn (S = 0) | ○ | X | X | |
| Ex. 6 | 40 ° C. 40% RH | every 2 nzls | ○ | ○ | ○ | Δ |
| Ex. 7 | " | every 3 nzls | ○ | ○ | Δ | X |
| Comp. 5 | " | All nzls 7.2 kHz | ○ | ○ | ○ | ○ |
| Comp. 6 | " | No vibrn (S = 0) | Δ | X | X | |

TABLE 15

T1 = 1 sec Ink III Ink Quantity: 8 pl

| | Environment | Vibrating Cond. | Total 4 | Rep. 12 | Time 20 | (sec) 30 |
|---|---|---|---|---|---|---|
| Ex. 6 | 20° C. 70% RH | every 2 nzls | ○ | ○ | X | X |
| Ex. 7 | " | every 3 nzls | ○ | Δ | X | X |
| Comp. 5 | " | All nzls 7.2 kHz | ○ | ○ | Δ | Δ |
| Comp. 6 | " | No vibrn (S = 0) | X | X | | |
| Ex. 6 | 20° C. 40% RH | every 2 nzls | ○ | X | X | |
| Ex. 7 | " | every 3 nzls | Δ | X | X | |
| Comp. 5 | " | All nzls 7.2 kHz | ○ | Δ | X | X |
| Comp. 6 | " | No vibrn (S = 0) | X | X | | |
| Ex. 6 | 40° C. 40% RH | every 2 nzls | Δ | X | X | |
| Ex. 7 | " | every 3 nzls | X | X | | |
| Comp. 5 | " | All nzls 7.2 kHz | ○ | Δ | X | X |
| Comp. 6 | " | No Vibrn (S = 0) | X | X | | |

TABLE 16

T1 = 2 sec Ink III Ink Quantity: 40 pl

| | Environment | Vibrating Cond. | Total 4 | Rep. 12 | Time 20 | (sec) 30 |
|---|---|---|---|---|---|---|
| Ex. 6 | 20° C. 70% RH | every 2 nzls | ○ | ○ | ○ | Δ |
| Ex. 7 | " | every 3 nzls | ○ | ○ | ○ | X |
| Comp. 5 | " | All nzls 7.2 kHz | ○ | ○ | ○ | ○ |
| Ex. 6 | 20° C. 40% RH | every 2 nzls | ○ | Δ | X | X |
| Ex. 7 | " | every 3 nzls | ○ | X | X | |
| Comp. 5 | " | All nzls 7.2 kHz | ○ | ○ | X | X |
| Ex. 6 | 40° C. 40% RH | every 2 nzls | ○ | Δ | X | X |
| Ex. 7 | " | every 3 nzls | ○ | X | X | |
| Comp. 5 | " | All nzls 7.2 kHz | ○ | ○ | X | X |

TABLE 17

T1 = 2 sec Ink III Ink Quantity: 8 pl

| | Environment | Vibrating Cond. | Total 4 | Rep. 12 | Time 20 | (sec) 30 |
|---|---|---|---|---|---|---|
| Ex. 6 | 20° C. 70% RH | every 2 nzls | Δ | Δ | X | X |
| Ex. 7 | " | every 3 nzls | Δ | X | X | |
| Comp. 5 | " | All nzls 7.2 kHz | ○ | ○ | ○ | ○ |
| Ex. 6 | 20° C. 40% RH | every 2 nzls | X | X | | |
| Ex. 7 | " | every 3 nzls | X | X | | |
| Comp. 5 | " | All nzls 7.2 kHz | X | X | | |
| Ex. 6 | 40° C. 40% RH | every 2 nzls | X | X | | |
| Ex. 7 | " | every 3 nzls | X | X | | |
| Comp. 5 | " | All nzls 7.2 kHz | X | X | | |

TABLE 18

T1 = 3 sec Ink III Ink Quantity: 40 pl

| | Environment | Vibrating Cond. | Total 4 | Rep. 12 | Time 20 | (sec) 30 |
|---|---|---|---|---|---|---|
| Ex. 6 | 20° C. 70% RH | every 2 nzls | ○ | ○ | X | X |
| Ex. 7 | " | every 3 nzls | ○ | Δ | X | X |
| Comp. 5 | " | All nzls 7.2 kHz | ○ | ○ | Δ | X |
| Ex. 6 | 20° C. 40% RH | every 2 nzls | X | X | | |
| Ex. 7 | " | every 3 nzls | X | X | | |
| Comp. 5 | " | All nzls 7.2 kHz | Δ | X | X | |
| Ex. 6 | 40° C. 40% RH | every 2 nzls | X | X | | |
| Ex. 7 | " | every 3 nzls | X | X | | |
| Comp. 5 | " | All nzls 7.2 kHz | Δ | X | X | |

TABLE 19

T1 = 3 sec Ink III Ink Quantity: 8 pl

| | Environment | Vibrating Cond. | Total 4 | Rep. 12 | Time 20 | (sec) 30 |
|---|---|---|---|---|---|---|
| Ex. 6 | 20° C. 70% RH | every 2 nzls | Δ | X | X | |
| Ex. 7 | " | every 3 nzls | X | X | | |
| Comp. 5 | " | All nzls 7.2 kHz | ○ | X | X | |
| Ex. 6 | 20° C. 40% RH | every 2 nzls | X | X | | |
| Ex. 7 | " | every 3 nzls | X | X | | |
| Comp. 5 | " | All nzls 7.2 kHz | X | X | | |
| Ex. 6 | 40° C. 40% RH | every 2 nzls | X | X | | |
| Ex. 7 | " | every 3 nzls | X | X | | |
| Comp. 5 | " | All nzls 7.2 kHz | X | X | | |

The similar tendency described in conjunction with Tables 2–7 is observed in Tables 8–13 concerning Ink II and in Tables 14–19 concerning Ink III. However, since the viscosities of Ink II and Ink III are apt to increase, as compared with Ink I, dot displacement becomes more conspicuous. Especially in Tables 15, 17, and 19 using 8 pL ink droplet of Ink III, dot displacement was out of the acceptable range even through spraying operations were conducted every four seconds. To overcome such a large dot displacement, some countermeasure has to be taken, for example, applying slight vibration to the nozzles until immediately before the printing operation.

It should be noted, however, that the conventional arrangement, in which all the nozzles are vibrated simultaneously at the reference frequency F, also requires spraying operations every four seconds when using 8 pL ink droplet, as shown in Comparison Test 5 (Comp. 5). From this fact, the present invention achieves substantially the same effect as the conventional technique.

When using an ink with a high tendency of viscosity increase, such as Ink III, in an actual printer, slight vibration has to be applied to the nozzles until immediately before the printing operation. To realize this, the piezoelectric elements are controlled to produce slight vibrator in the printing area so as not to prevent the printing operation. MPU50 shown in FIG. 2 may control such a timing of applying non-ejection vibration signals.

From the results shown in Tables 2 through 19, it was confirmed that dot displacement becomes conspicuous, (1) as the vibration interval T1 increases, (2) as the total repetition time (i.e., non-ejecting time) Tt becomes longer, (3) as the humidity decreases, or (4) as the tendency or viscosity increase of ink increases. In addition, as the number of groups increases, that is, as the frequency becomes lower, it becomes difficult to control placing the dot to be formed at the correct position on the recording medium. As the solid ingredient contained in the ink increases, dot displacement is likely to occur.

Even in the conditions where dot displacement is likely to occur, dot displacement can be effectively prevented by the sequential group-by-group vibration in combination with spraying operations for refreshing the ink.

In the test results obtained in the embodiment, it may appears from some estimation results that dot displacement is not sufficiently prevented when the nozzles are grouped into four groups to drive every fourth piezoelectric element. However, this is due to the inks, the environment, and the vibration conditions set in the test. By determining and setting the optimum conditions and environment, nozzles can be grouped into five or six groups, while still achieving the effect of preventing the ink viscosity from increasing. With the ink-jet printing apparatus according to the embodiment, the number of times for driving the piezoelectric element is greatly reduced to ½, ⅓, ¼, . . . , of the conventional technique, while achieving the same viscosity-increase prevention effect as the conventional technique for applying the vibration signal to all the piezoelectric elements simultaneously at the reference frequency.

Another frequency-dividing effect of the ink-jet printing apparatus according to the embodiment will be explained using an example of printing on an A4-size (6 inches×9 inches) paper Data are printed all over the A4 paper at a resolution of 600 DPI, with 7% print ratio, at the maximum ejection frequency of 7.2 kHz, by moving the recording head with fifty nozzles to and fro. A horizontal scan takes about 0.95 seconds (which is the sum of constant scan time of 0.75 seconds and acceleration time of 0.2 seconds, where 0.75=(8.27+0.73)×600/7.2 kHz, 0.2=0.1×2), and total of 108 scans is made for the printing operation with a scanning time of about 103 seconds. The average number of ink-ejections at each nozzle is about 27,201.

Meanwhile, the reference frequency of non-ejecting vibration for causing slight vibration at the liquid surface of the ink is set to 7.2 kHz, and slight vibration is applied for 0.1 seconds in the return area. Then, the number of times of driving the piezoelectric element for the slight vibration is 77,800. If a 150-dot spraying operation is carried out for every 12 seconds in the return area, the total number of spraying operations is 8, and the driving number of times becomes 1,200.

Although the voltage applied for non-ejecting vibration is slightly lower than the driving signal for ejecting ink, it is considered that the non-ejecting vibration signal affects the service life of the piezoelectric element to a similar extent as the driving signal. If non-ejecting vibration is carried out between the scans using the conventional technique for applying the non-ejecting vibration signal to all the piezoelectric elements simultaneously, the service life of the piezoelectric element is shortened to about ¼ (which equals 28400/(28400+77800)).

On the other hand, if slight vibration is applied to every other nozzle (two nozzle groups) using the ink-jet printing apparatus according to the embodiment, the service life of the piezoelectric element becomes ⅔ (which equals 28400/(28400+38900)). If every third nozzle is vibrated, then the service life of the piezoelectric element becomes about ½ (which equals 28400/(28400+25900)). As compared with the conventional technique for applying a non-ejecting vibration signal to all the piezoelectric elements simultaneously, the service life of the piezoelectric element can be greatly extended.

Although the present invention has been described based on the preferred embodiment, the invention is not limited to the embodiment, and there are many modifications and substitutions that can be made without departing from the scope of the present invention.

With the ink-jet printing apparatus according to the present invention, undesirable dot displacement can be prevented, while extending the service life of the apparatus, by driving at least two groups of ink-ejection energy generators (e.g., piezoelectric elements) for causing slight vibration at the liquid surface of the ink.

If slight vibration is applied only in the non-printing area, the number of times of applying non-ejecting vibration signals can be further reduced, and the service life of the ink-ejection energy generator can be further extended.

Carrying out slight vibration in combination with spraying operation can prevent increase of the ink viscosity and ink jam more efficiently, while extending the service life of the ink-ejection energy generators.

What is claimed is:

1. An ink-jet printing apparatus comprising:

a plurality of nozzles configured to eject ink, the nozzles being grouped into two or more nozzle groups;

pressure chambers, each being provided to one of the nozzles;

ink-ejection energy generators, each being provided for one of the pressure chambers; and a vibration controller configured to supply a non-ejecting vibration signal to the ink-ejection energy generators of each nozzle group at a different timing, the non-ejecting vibration signal causing the corresponding ink-ejection energy generator to produce energy so as not to cause the ink to eject from the nozzle, but cause a liquid surface of the ink to slightly vibrate in the associated nozzle, wherein the vibration controller has a reference frequency for causing the slight vibration at the liquid surface of the ink, and wherein the vibration controller includes a frequency-dividing vibration unit configured to divide the reference frequency according to the number of the nozzle groups and to drive the ink-ejection energy generators in the respective nozzle groups, while shifting a phase of the non-ejecting vibration signal for each nozzle group.

2. The ink-jet printing apparatus according to claim 1, wherein the nozzles are arranged so that every predetermined number of nozzles belongs to the same nozzle group, said predetermined number being consistent with the number of nozzle groups.

3. The ink-jet printing apparatus according to claim 2, wherein the ink-jet printing apparatus has a printing area in which a printing operation is carried out on a recording medium, and a non-printing area, in which the printing operation is not carried out, and wherein the vibration controller supplies the non-ejecting vibration signal to the ink-ejection energy generators in the non-printing area.

4. The ink-jet printing apparatus according to claim 3, further comprising an ink-jet recording head on which said plurality of nozzles are arranged, wherein the ink-jet printing apparatus carries out the printing operation by moving the ink-jet recording head to and fro, and wherein the ink-jet printing apparatus has a return area as the non-printing area, in which the vibration controller supplies the non-ejecting vibration signal to the ink-ejection energy generators.

5. The ink-jet printing apparatus according to claim 4, wherein the ink-ejection energy generator is a piezoelectric element.

6. The ink-jet printing apparatus according to claim 5, wherein the pressure chambers are formed integrally with the ink-jet recording head.

7. The ink-jet printing apparatus according to claim 5, wherein the vibration controller supplies a driving signal to the ink-ejection energy generators for the printing operation in the printing area, and wherein the reference frequency is synchronized with a frequency of the driving signal.

8. The ink-jet printing apparatus according to claim 4, wherein the pressure chambers are formed integrally with the ink-jet recording head.

9. The ink-jet printing apparatus according to claim 4, wherein the vibration controller supplies a driving signal to the ink-ejection energy generators for the printing operation in the printing area, and wherein the reference frequency is synchronized with a frequency of the driving signal.

10. The ink-jet printing apparatus according to claim 4, wherein the vibration controller causes the ink-jet printing apparatus to carry out a refreshing spray operation in the return area.

11. The ink-jet printing apparatus according to claim 3, wherein the ink-ejection energy generator is a piezoelectric element.

12. The ink-jet printing apparatus according to claim 11, wherein the vibration controller supplies a driving signal to the ink-ejection energy generators for the printing operation in the printing area, and wherein the reference frequency is synchronized with a frequency of the driving signal.

13. The ink-jet printing apparatus according to claim 3, wherein the vibration controller supplies a driving signal to the ink-ejection energy generators for the printing operation in the printing area, and wherein the reference frequency is synchronized with a frequency of the driving signal.

14. The ink-jet printing apparatus according to claim 3, wherein the vibration controller causes the ink-jet printing apparatus to carry out a refreshing spray operation in the non-printing area.

15. The ink-jet printing apparatus according to claim 2, wherein the ink-ejection energy generator is a piezoelectric element.

16. The ink-jet printing apparatus according to claim 15, wherein the vibration controller supplies a driving signal to the ink-ejection energy generators for causing the ink to eject from the nozzle for a printing operation, and wherein the reference frequency is synchronized with a frequency of the driving signal.

17. The ink-jet printing apparatus according to claim 2, wherein the vibration controller supplies a driving signal to the ink-ejection energy generators for causing the ink to eject from the nozzle for a printing operation, and wherein the reference frequency is synchronized with a frequency of the driving signal.

18. The ink-jet printing apparatus according to claim 1, wherein the vibration controller supplies a driving signal to the ink-ejection energy generators for causing the ink to eject from the nozzle for a printing operation, and wherein the reference frequency is synchronized with a frequency of the driving signal.

* * * * *